US007486244B2

(12) United States Patent
Sung et al.

(10) Patent No.: US 7,486,244 B2
(45) Date of Patent: Feb. 3, 2009

(54) RESONANT FREQUENCY TUNABLE ANTENNA

(75) Inventors: Jae Suk Sung, Kyungki-Do (KR); Tae Sung Kim, Seoul (KR)

(73) Assignee: Samsung Electro-Mechanics Co., Ltd., Suwon, Kyungki-Do (KR)

( * ) Notice: Subject to any disclaimer, the term of this patent is extended or adjusted under 35 U.S.C. 154(b) by 0 days.

(21) Appl. No.: 11/466,889

(22) Filed: Aug. 24, 2006

(65) Prior Publication Data

US 2007/0046545 A1 Mar. 1, 2007

(30) Foreign Application Priority Data

Aug. 25, 2005 (KR) ..... 10-2005-0078449

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS 4,937,585 A * 6/1990 Shoemaker ..... 343/700 MS
6,469,673 B2 * 10/2002 Kaiponen ..... 343/703
6,501,427 B1 * 12/2002 Lilly et al. ..... 343/700 MS
2003/0142022 A1 7/2003 Ollikainen et al.

FOREIGN PATENT DOCUMENTS

KR 2002-93977 A 12/2002
KR 10-2004-0081148 9/2004

OTHER PUBLICATIONS

Korean Intellectual Property Office, Office Action mailed Oct. 24, 2006.

* cited by examiner

*Primary Examiner*—Michael C Wimer
(74) *Attorney, Agent, or Firm*—Lowe Hauptman Ham & Berner

(57) ABSTRACT

In a resonant frequency tunable antenna, a body includes a dielectric substance and a magnetic substance. A first radiator is disposed on a first predetermined area of the body and has a feeding pin connected thereto. A second radiator is disposed on a second predetermined area of the body. Also, a switch is disposed on the body to be connected between the first and second radiators. In addition, a power supply pin is electrically connected to the switch and extends downward through the body.

8 Claims, 4 Drawing Sheets

(a)

(b)

(a)

(b)

RESONANT FREQUENCY TUNABLE ANTENNA

CLAIM OF PRIORITY

This application claims the benefit of Korean Patent Application No. 2005-78449 filed on Aug. 25, 2005 in the Korean Intellectual Property Office, the disclosure of which is incorporated herein by reference.

BACKGROUND OF THE INVENTION

1. Field of the Invention

The present invention relates to a resonant frequency tunable antenna, more particularly which adjusts an electrical resonant length via a switch to vary a resonant frequency into a desired available frequency band.

2. Description of the Related Art

With recent growth in the telecommunication field such as a mobile multimedia broadcasting which adopts a new available frequency, antennas are increasingly required to perform with high capability. The antennas have been exhibiting characteristics of a dual band covering e.g., GSM/DCS bands. But the antennas are more required to achieve quad-band properties for covering four different bands and even multi-band properties.

In a method to meet such a demand, a resonant length of a radiator of an antenna has been selectively adjusted using a switch. Korean Patent Publication No. 2004-0081148, entitled "Tunable Antenna for Wireless Communication Terminals," discloses a multi-band antenna employing an extending line formed on a printed circuit board and a switch.

FIG. 1 is a perspective view illustrating the multi-band antenna proposed in the aforesaid document.

The antenna shown in FIG. 1 has a radiator 15 mounted on a printed circuit board 11. The radiator 15 is connected to a feeding pin 12 and a short pin 14, respectively. The radiator 15 is connected to a transmission line 16*b* formed on the printed circuit board 11 by a transmission pin 16*a*. Also, the transmission line 16*b* is selectively connected to two extending lines 18*a* and 18*b* by a switch 17 disposed on the printed circuit board 11, thus achieving different resonant frequencies depending on the selected extending line 18*a* and 18*b*.

However, in the conventional antenna, a switch and lines with various lengths are installed on the printed circuit board where an antenna is mounted. This limits an available space of the printed circuit board, also requiring an additional pin structure connected to lines on the printed circuit board in addition to a feeding pin and a ground pin disposed on a side of the antenna. This disadvantageously complicates the antenna structure.

SUMMARY OF THE INVENTION

The present invention has been made to solve the foregoing problems of the prior art and therefore an object according to certain embodiments of the present invention is to provide a new resonant frequency tunable antenna which has a switch formed on a chip body with a radiator disposed thereon and a power supply means disposed inside the chip body to supply a voltage for controlling the switch, thereby simplifying an overall structure.

According to an aspect of the invention for realizing the object, there is provided a resonant frequency tunable antenna comprising: a body comprising a dielectric substance or a magnetic substance; a first radiator disposed on a first predetermined area of the body and having a feeding pin connected thereto; a second radiator disposed on a second predetermined area of the body; a switch disposed on the body to be connected between the first and second radiators; and a power supply pin electrically connected to the switch, and extending downward through the body.

Preferably, the power supply pin is connected to the first radiator to supply a voltage to the switch via a portion of the second radiator.

The power supply pin is extended downward through the body.

According to a preferred embodiment of the invention, the body comprises: an upper plate where the first and second radiators and the switch are disposed; and a support having the upper plate mounted thereon.

Preferably, the upper plate comprises a printed circuit board. At least one chip inductor or capacitor is mounted on the upper plate. Also, the support comprises a housing structure opened at an underside.

Alternatively, the invention is employed in not only a dual band but also a triple-band and a multi-band. The resonant frequency tunable antenna further comprises: at least one third radiator formed on another area of the body, and connected in series to the first and second radiators by at least one additional switch; at least one additional power supply pin electrically connected to the switch, and extending downward through the body.

The first radiator comprises an inverse F-type radiator with a ground pin additionally connected thereto. At this time, the ground pin is extended downward through the body.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 1:
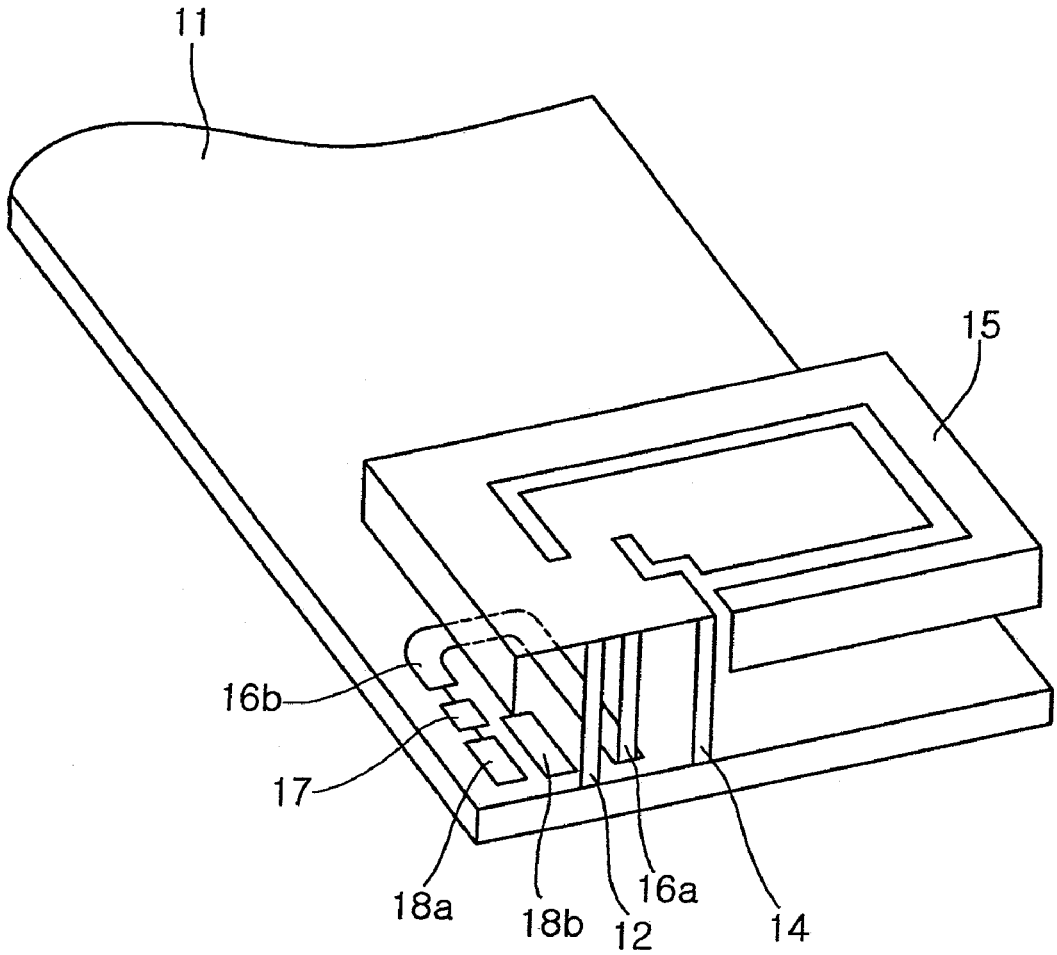
Prior art FIG. 1
FIG. 1 is a perspective view illustrating a conventional antenna using a switch.
Figure 2:
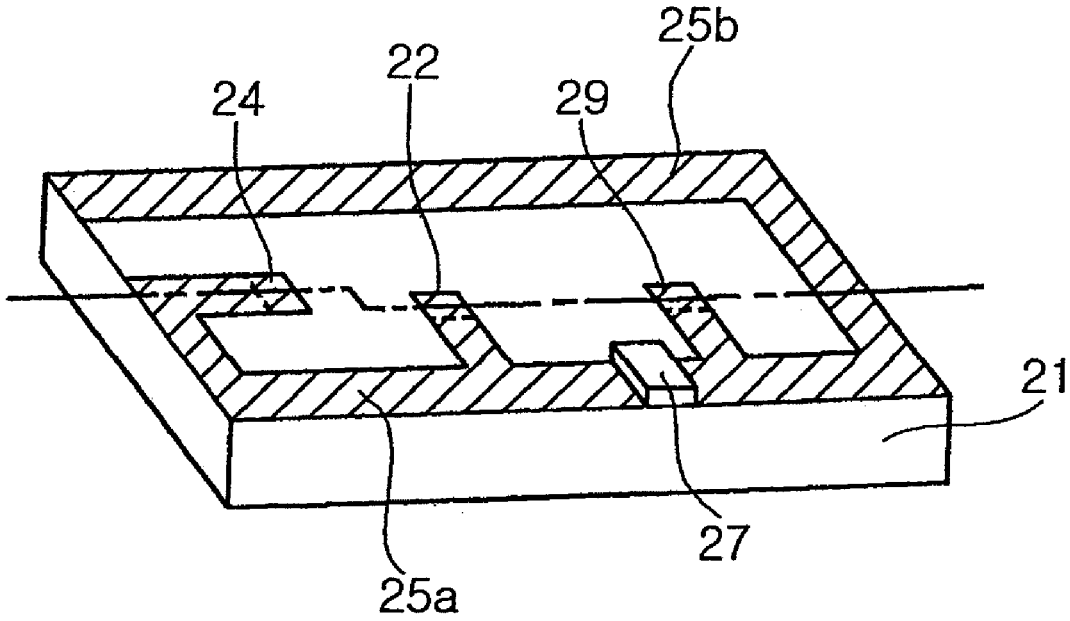
FIG. 2*a* is a perspective illustrating an antenna according to an embodiment of the invention.
FIG. 2*b* is a side cross-sectional view illustrating an antenna according to an embodiment of the invention.
Figure 2:
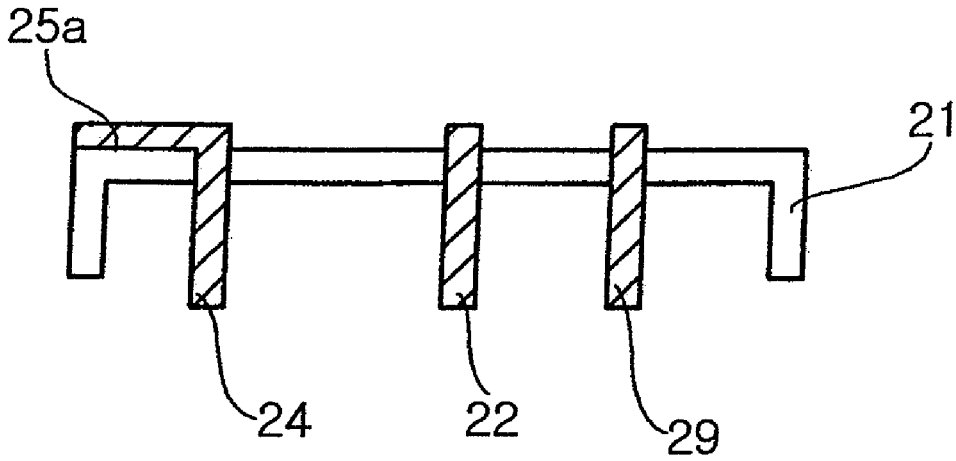

FIG. 2*a* is a perspective view illustrating an antenna according to an embodiment of the invention, and FIG. 2*b* is a side sectional view illustrating an antenna according to an embodiment of the invention.

Referring to FIG. 2*a*, the antenna of the invention includes a body 21 made of a dielectric substance or a magnetic substance. The body 21 has an inverted F-type first radiator 25*a* formed on a first predetermined area thereof and connected to a ground pin 24 and a feeding pin 22. The body 21 has a second radiator 25*b* formed on a second predetermined area thereof. The second radiator 25*b* is selectively connected to the first radiator 25*a* to convert a resonant frequency of the first radiator 25*a* into a short wavelength, thereby providing an additional other resonant frequency.

A switch 27 is disposed between the first and second radiators 25*a* and 25*b*. The switch 27 may adopt a P-type, Intrinsic, N-type diode (PIN) diode or a transistor device such as a Metal Oxide Semiconductor Field Effect Transistor (MOSFET) and be configured into various structures. In the invention, the switch 27 is directly mounted on the body 21 and controlled by a power supply pin 29.

The power supply pin 29 is not a pattern disposed along a side of the body 21 as in the prior art but is extended downward through the body 21. The power supply pin 29 supplies a voltage for turning on/off the switch 27 through a portion of the second radiator 25*b*.

In this fashion, the power supply pin 29 is disposed inside the body 21 without having to be exposed at the side thereof. This allows the first and second radiators 25*a* and 25*b* to be designed and patterned with higher flexibility. As in this embodiment of the invention, such a structure of the power supply pin 29 is applicable to the conventional feeding pin 22 and ground pin 24. That is, as shown in FIG. 2*b*, like the power supply pin 29, the feeding pin 22 and the ground pin 24 are extended through the body 21, which is a housing structure opened at an underside.

Figure 3:
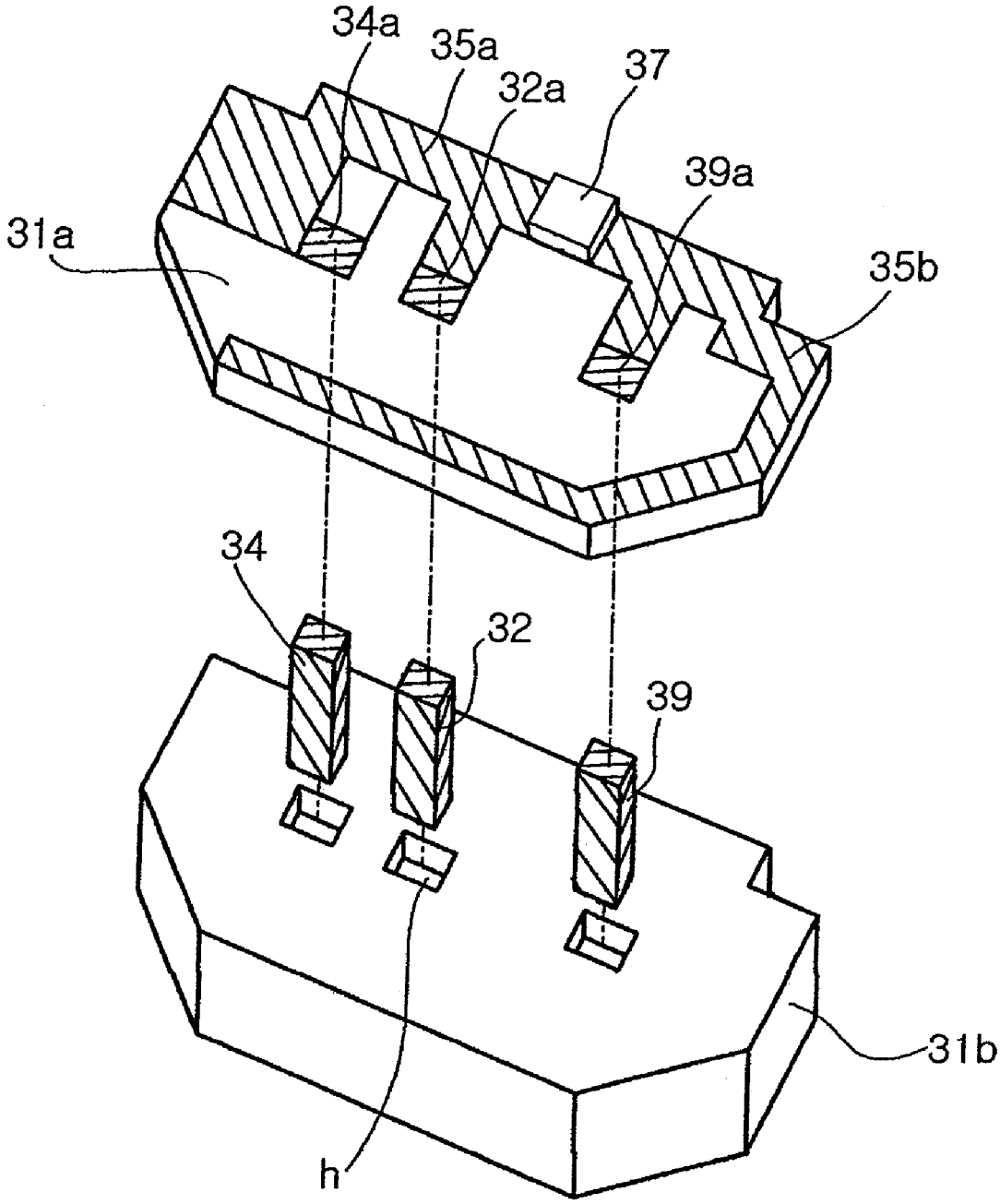
FIG. 3 is an exploded perspective view illustrating an antenna according to a preferred embodiment of the invention.

More preferably, the invention may partially employ a printed circuit board. FIG. 3 illustrates a preferred embodiment of the invention.

Referring to FIG. 3, an antenna of this embodiment includes a body comprised of a support 31*b* and an upper plate 31*a* formed thereon. Preferably, the upper plate 31*a* is a printed circuit board and the support 31*b* is a housing structure opened at an underside as shown in FIG. 2*b*.

The upper plate 31*a* has first and second radiators 35*a* and 35*b* formed thereon. In a similar manner to the aforesaid embodiment of the invention, the first radiator 35*a* is configured as an inverse F-type antenna having a ground pin 34 and a feeding pin 32 connected thereto.

A switch 37 connected between the first and second radiators 35*a* and 35*b* is directly mounted on the upper plate 31*a* and may be electrically connected to a power supply pin 39 extending through the upper plate 31*a* and the support 31*a*. The power supply pin 39 supplies a voltage for turning on/off the switch 37 through a portion of the second radiator 35*b*.

Also, in this embodiment of the invention, like the power supply pin 39, the feeding pin 32 and the ground pin 34 may be extended through the upper plate 31*a* and the support 31*b*.

This embodiment employs a printed circuit board as the upper plate 31*a*, thereby yielding various advantages. That is, the first and second radiators 35*a* and 35*b* in the form of a conductive pattern are easily designed and manufactured, and also the switch 37 is easily disposed on the body. Further, to achieve more precise tuning, a passive device (not illustrated) such as a chip inductor and a capacitor can be easily mounted.

Figure 4:
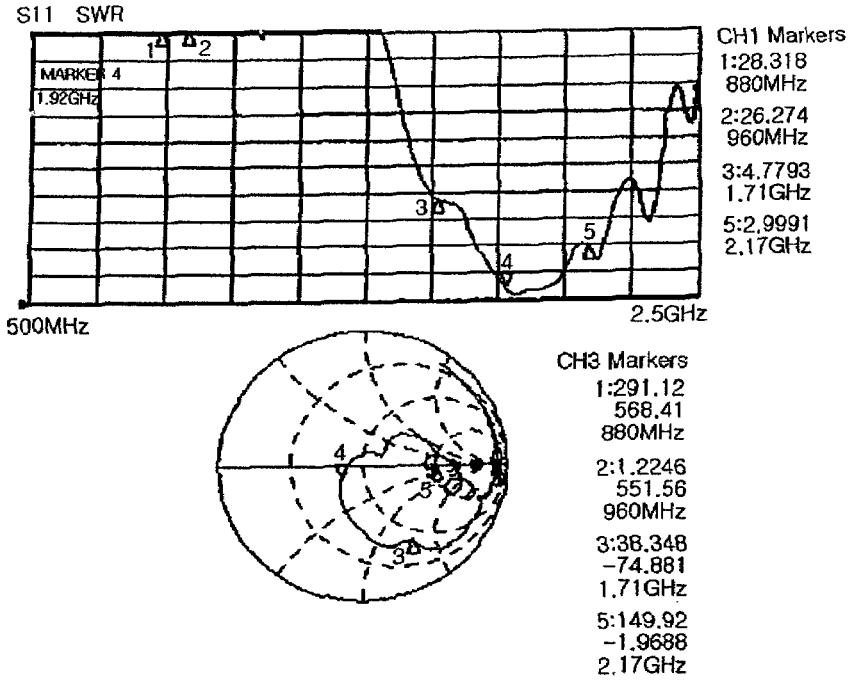
FIGS. 4*a* and 4*b* are graphs illustrating VSWR properties before and after a voltage is supplied to a switch according to an embodiment of the invention.
Figure 4:
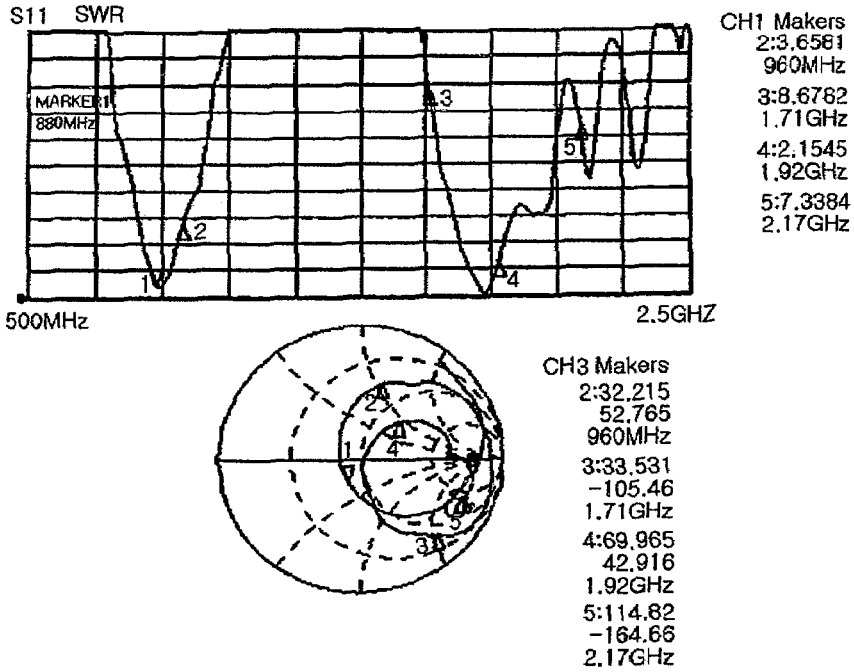

An antenna having a similar structure to FIG. 3 was manufactured. In the antenna, a DC voltage was supplied through a power supply pin to turn on/off a switch and VSWR properties of the antenna were measured. FIGS. 4*a* and 4*b* illustrate the results.

As shown in FIG. 4*a*, when the switch is off, a resonant frequency is determined by a first radiator and is measured at 1.92 GHz. But after the switch is turned on via the power supply pin, as shown in FIG. 4*b*, an additional resonant frequency is generated at 880 MHz as shown in FIG. 4*b*. In this fashion, the antenna structured according to the invention allows the resonant frequency to be adjusted by turn-on/off of the switch.

In the aforesaid embodiment, only one radiator is connected to a switch. But at least two radiators may be connected in series to at least two switches. For example, at least one third radiator may be disposed on another area of the body and connected in series to the first and second radiators by at least one additional switch. At this point, at least one power supply pin may be additionally disposed corresponding to the additional radiator.

Also, in the embodiment of the invention, the first radiator is structured as an inverse F-type radiator, which includes a feeding pin and a ground pin. However, the invention is not limited thereto but may feature other structure such as a monopol with only the feeding pin.

As set forth above, according to preferred embodiments of the invention, a resonant frequency tunable antenna has a switch disposed on a body where a radiator is disposed, and a power supply means disposed inside the body to supply a voltage for controlling the switch. This simplifies an overall structure of the antenna. Especially, according to the invention, radiators and a switch can be mounted on a printed circuit board, thereby simplifying further designing and manufacture of the antenna and enabling a passive device to be easily mounted for additional tuning.

While the present invention has been shown and described in connection with the preferred embodiments, it will be apparent to those skilled in the art that modifications and variations can be made without departing from the spirit and scope of the invention as defined by the appended claims.

What is claimed is:

1. A resonant frequency tunable antenna, comprising:

a body comprising a dielectric substance or a magnetic substance;

a first radiator disposed on a first predetermined area of the body and having a feeding pin connected thereto;

a second radiator disposed on a second predetermined area of the body;

a switch disposed on the body to be connected between the first and second radiators; and a power supply pin electrically connected to the switch, and extending downward through the body;

wherein the body comprises:

an upper plate where the first and second radiators and the switch are disposed; and a support having the upper plate mounted thereon; and wherein the upper plate comprises a printed circuit board.

2. The resonant frequency tunable antenna according to claim 1, wherein the power supply pin is connected to the second radiator to supply a voltage to the switch via a portion of the second radiator.

3. The resonant frequency tunable antenna according to claim 1, wherein the power supply pin extends downward through the body without being exposed at side faces of said body where the first and second radiators and the switch are not disposed.

4. The resonant frequency tunable antenna according to claim 1, wherein at least one chip inductor or capacitor is mounted on the upper plate.

5. The resonant frequency tunable antenna according to claim 1, wherein the support comprises a housing structure opened at an underside.

6. The resonant frequency tunable antenna according to claim 1, wherein the first radiator comprises an inverse F-type radiator with a ground pin additionally connected thereto.

7. The resonant frequency tunable antenna according to claim 6, the ground pin extends downward through the body.

8. A resonant frequency tunable antenna, comprising:

a body comprising a dielectric substance or a magnetic substance;

a first radiator disposed on a first predetermined area of the body and having a feeding pin connected thereto;

a second radiator disposed on a second predetermined area of the body;

a switch disposed on the body to be connected between the first and second radiators; and a power supply pin electrically connected to the switch, and extending downward through the body;

wherein the body comprises:

an upper plate where the first and second radiators and the switch are disposed; and a support having the upper plate mounted thereon; and wherein the power supply pin is connected to the second radiator to supply a voltage to the switch via a portion of the second radiator.

* * * * *